US011152703B2

(12) United States Patent
Segador Alvarez et al.

(10) Patent No.: US 11,152,703 B2
(45) Date of Patent: Oct. 19, 2021

(54) ULTRA COMPACT RADIATING ELEMENT

(71) Applicant: HUAWEI TECHNOLOGIES CO., LTD., Guangdong (CN)

(72) Inventors: Juan Segador Alvarez, Munich (DE); Tao Tang, Dongguan (CN); Ajay Babu Guntupalli, Munich (DE); Bruno Biscontini, Munich (DE)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/845,649

(22) Filed: Apr. 10, 2020

(65) Prior Publication Data

US 2020/0243970 A1 Jul. 30, 2020

Related U.S. Application Data

(63) Continuation of application No. PCT/EP2017/076059, filed on Oct. 12, 2017.

(51) Int. Cl.
*H01Q 5/357* (2015.01)
*H01Q 9/04* (2006.01)
(Continued)

(52) U.S. Cl.
CPC ..... *H01Q 5/357* (2015.01); *H01Q 5/49* (2015.01); *H01Q 5/50* (2015.01); *H01Q 9/0464* (2013.01); *H01Q 21/24* (2013.01)

(58) Field of Classification Search
CPC ..... H01Q 5/357; H01Q 5/50; H01Q 9/0464; H01Q 5/49; H01Q 5/314; H01Q 1/36; H01Q 9/28; H01Q 21/26
See application file for complete search history.

(56) References Cited

U.S. PATENT DOCUMENTS 6,452,549 B1 * 9/2002 Lo ..... H01Q 9/28 343/700 MS
6,930,650 B2 8/2005 Ttl
(Continued)

FOREIGN PATENT DOCUMENTS

CN 1577974 A 2/2005
CN 204596981 U 8/2015
(Continued)

OTHER PUBLICATIONS

Bi Qun Wu et al.,"A Broadband Dual-Polarized Magneto-Electric Dipole Antenna With Simple Feeds",IEEE Antennas and Wireless Propagation Letters, vol. 8, 2009,total 4 pages.
(Continued)

*Primary Examiner* — Vibol Tan
(74) *Attorney, Agent, or Firm* — Womble Bond Dickinson (US) LLP

(57) ABSTRACT

A dual band antenna element suitable for use in a compact multiband antenna array is described. The dual band antenna element may have a main radiating direction with a first radiating element for use in a first frequency band, a first electrically closed ring for use in the first frequency band galvanically isolated from and arranged at a predetermined distance from the first radiating element in the main radiating direction. The first ring) may at least partially overlap the first radiating element in the main radiating direction. The dual band antenna element may also have a second radiating element for use in a second frequency band, where the second radiating element is arranged within a circumference of the first radiating element and is arranged substantially at the predetermined distance (D) from the first radiating element in the radiation direction.

14 Claims, 5 Drawing Sheets

(51) Int. Cl.

| | |
|---|---|
| ***H01Q 5/50*** | (2015.01) |
| ***H01Q 5/49*** | (2015.01) |
| ***H01Q 21/24*** | (2006.01) |

(56) References Cited

U.S. PATENT DOCUMENTS

| | | | | |
|---|---|---|---|---|
| 7,579,999 | B2 * | 8/2009 | Bo.beta. | H01Q 9/06 343/795 |
| 9,728,856 | B2 * | 8/2017 | Foo | H01Q 15/18 |
| 10,854,997 | B2 * | 12/2020 | Quitt | H01Q 25/001 |
| 2004/0263392 | A1 * | 12/2004 | Bisiules | H01Q 9/0457 343/700 MS |
| 2008/0180333 | A1 * | 7/2008 | Martiskainen | H01Q 1/243 343/722 |
| 2012/0062437 | A1 * | 3/2012 | Hung | H01Q 5/357 343/799 |
| 2013/0215832 | A1 | 8/2013 | Gao et al. | |
| 2015/0042533 | A1 | 2/2015 | Cheng | |
| 2017/0317412 | A1 * | 11/2017 | Wu | H01Q 5/378 |

FOREIGN PATENT DOCUMENTS

| | | | |
|---|---|---|---|
| CN | 205282641 | U | 6/2016 |
| CN | 106099325 | A | 11/2016 |
| CN | 205846220 | U | 12/2016 |
| CN | 107078383 | A | 8/2017 |
| EP | 1496569 | A1 | 1/2005 |
| EP | 3166178 | A1 | 5/2017 |
| EP | 3168927 | A1 | 5/2017 |
| WO | 03083992 | A1 | 10/2003 |
| WO | 2016090463 | A1 | 6/2016 |
| WO | 2017076714 | A1 | 5/2017 |
| WO | 2017084979 | A1 | 5/2017 |
| WO | 2017178037 | A1 | 10/2017 |

OTHER PUBLICATIONS

Ying Liu et al.,"A Novel Miniaturized Broadband Dual-Polarized Dipole Antenna for Base Station",IEEE Antennas and Wireless Propagation Letters, vol. 12, 2013,total 4 pages.

* cited by examiner

ULTRA COMPACT RADIATING ELEMENT

CROSS-REFERENCE TO RELATED APPLICATIONS

This application is a continuation of International Application No. PCT/EP2017/076059, filed on Oct. 12, 2017, the disclosure of which is hereby incorporated by reference in its entirety.

TECHNICAL FIELD

The present disclosure relates to a dual band antenna element, in particular to a dual band antenna element suitable for use in a compact multiband antenna array.

BACKGROUND

Cellular mobile communication systems often need to support a variety of frequency bands which are determined by regulatory bodies. The use of multiple frequency bands requires the use of different antenna elements that are adapted to the physical characteristics of each of the frequency bands.

Antenna locations, in particular for cellular mobile communication systems, often are space-restricted so that the use of multiple separate antennas for the different frequency bands is usually not an option. Furthermore, site upgrades and new deployments of antenna systems face limiting regulations. Regulations in general develop slower than the technology they regulate.

With the deployment of new technologies, in particular Long Term Evolution (LTE) systems, antennas need to support configurations with multiple ports and/or arrays. In some configurations, the support of 4×4 or even 8×8 multiple-input multiple-output (MIMO) is required. Furthermore, new frequency bands need to be supported. As the antennas for use with the new technologies should, if possible, fit in existing installations as much as possible, they need to be highly integrated.

SUMMARY

It is an objective of the embodiments of the present invention to provide a dual band antenna element, wherein the dual band antenna element overcomes one or more of the above-mentioned problems experienced by prior antenna systems. Furthermore, it is an object of the embodiments of the present invention to provide a concept for an improved dual band antenna element.

According to an embodiment of the invention, the dual band antenna element has a main radiation direction and comprises a first radiating element for use in a first frequency band. Furthermore, the dual band antenna element comprises a first electrically closed ring for use in the first frequency band. The first ring is galvanically isolated from and arranged at a predetermined distance from the first radiating element in the main radiating direction. The first ring at least partially overlaps the first radiating element in the main radiating direction. The dual band antenna element further comprises a second radiating element for use in a second frequency band, wherein a center frequency of the second frequency band is higher than a center frequency of the first frequency band. The second radiating element is arranged within a circumference of the first radiating element and the second radiating element is arranged substantially at the predetermined distance from the first radiating element in the radiation direction.

The first ring allows the first radiating element to be of reduced size, making the construction more compact. Furthermore, as the footprint of the dual band antenna element is reduced, the shadowing of antenna elements for use in the second frequency band that may be arranged on sides of the dual band antenna element in multiband architectures is also reduced.

In a further embodiment, the first ring has substantially the same outer dimensions as the first radiating element when viewed in the radiating direction. The first ring thus does not add to the outer dimensions of the dual band antenna element more than strictly necessary.

In a further embodiment, the predetermined distance between the first ring and the first radiating element is at most 0.15 of a wavelength, lambda, at the center frequency of the first frequency band. This distance provides an adequate reduction of overall size of the dual band antenna element while providing adequate performance of the individual radiating elements.

In a further embodiment, the first ring is floating. The first ring thus becomes a parasitic ring, making a compact construction of the dual band antenna element possible due to a reduction in required size of the first radiating element.

In a further embodiment, the first ring is arranged at the same height as the second radiating element. The second radiating element being elevated to the level of the first ring allows the second radiating element to operate without being shadowed by the first radiating element. Still, the second radiating element is arranged within the geometrical extent of the first radiating element.

In a further embodiment, the first ring and the second radiating element are arranged on the same carrier. Such a carrier could for example be a printed circuit board (PCB) or molded interconnect device (MID). This allows for easy production and positioning of the first ring in the second radiating element.

In a further embodiment, the dual band antenna element comprises filtering structures at feeding points of the first radiating element. Such filtering structures improve the inter-band isolation, leading to less high-band to low-band coupling. Changing the length of filtering structures, e.g. of filtering lines, changes the frequency at which the coupling is minimized.

In a further embodiment, the first radiating element comprises four slots regularly arranged in a circular fashion every 90°, wherein each slot can be excited so that the excitations are combined to obtain a certain polarization for a radio frequency (RF) signal radiated by the first radiating element. This leads to a so-called square dipole which is sufficiently broadband and has a suitable shape to fit a higher frequency radiating element inside.

In a further embodiment, the first radiating element has a cup-shaped form for embedding the second radiating element. Such a shape makes it particularly straightforward to embed the second radiating element.

In a further embodiment, a height of the dual band antenna element is less than 0.2 of the wavelength (lambda) at the center frequency of the first frequency band. Such a construction is very compact.

In a further embodiment, the width of the dual band antenna element is less than 0.32 of the wavelength (lambda) at the center frequency of the first frequency band. Very little space is used by such a dual band antenna element in an antenna array, allowing the construction of highly populated antenna arrays within the same geometric frame.

In a further embodiment, the dual band antenna element comprises a second electrically closed ring for use in the second frequency band surrounding the second radiating element.

In a further embodiment, the relative bandwidth of the dual band antenna element is more than 30% in the first frequency band.

The relative bandwidth in a frequency band is defined as:

$$\text{Relative Bandwith} = \frac{2 \times (F_{max} - F_{min})}{(F_{max} + F_{min})};$$

wherein $F_{max}$ is the upper boundary of the frequency band and $F_{min}$ is the lower boundary of the frequency band.

In a further embodiment, the relative bandwidth of the dual band antenna element is more than 60% in the second frequency band.

In a further embodiment, the dual band antenna element comprises a bottom printed circuit board wherein the first radiating element is connected to the bottom printed circuit board, wherein the bottom printed circuit board comprises transmission lines and an interface for connecting the first radiating element to the distribution network. Using a printed circuit board allows for easy construction of the bottom as well as the feeding lines and/or transmission lines to the first radiating element.

The terms "horizontal", "vertical", "above", "top" and "bottom" as used in this document are intended only to describe the relative position of the elements to each other. However, these terms are not intended to describe the orientation of any dual band antenna element with respect to the Earth's surface. The dual band antenna element may be oriented in any position with respect to the Earth's surface.

These and other aspects of embodiments of the invention will be apparent from the embodiment(s) described below.

BRIEF DESCRIPTION OF THE DRAWINGS

To illustrate the technical features of embodiments of the present invention more clearly, the accompanying drawings provided for describing the embodiments are introduced briefly in the following. The accompanying drawings in the following description are merely some embodiments of the present invention, but modifications of these embodiments are possible without departing from the scope of the present invention as defined in the claims.

DETAILED DESCRIPTION

Figure 1:
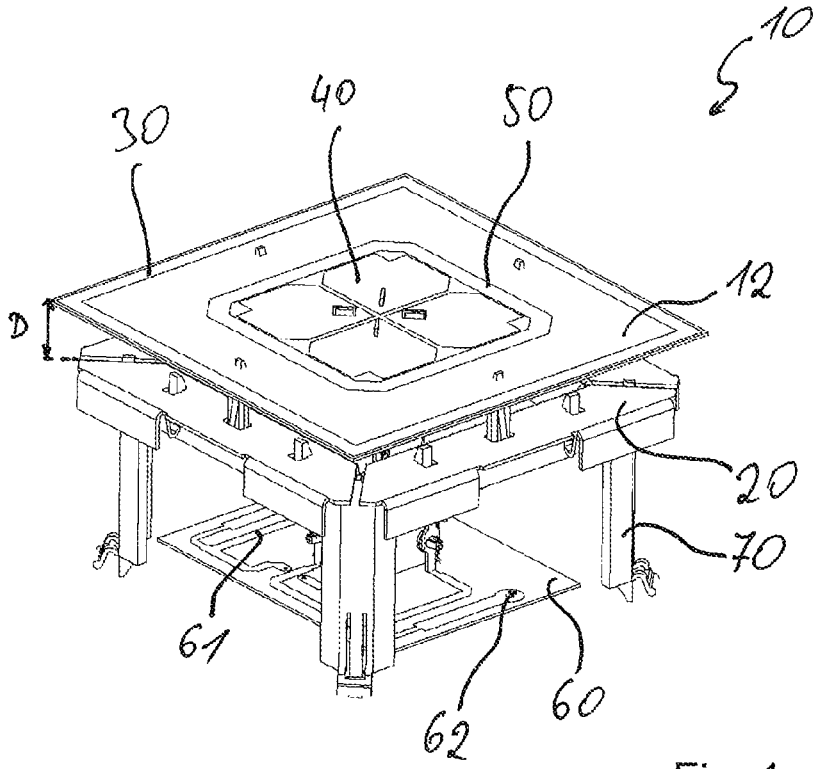
FIG. 1 shows a perspective view of the top of a dual band antenna element according to an embodiment of the invention.
Figure 2:
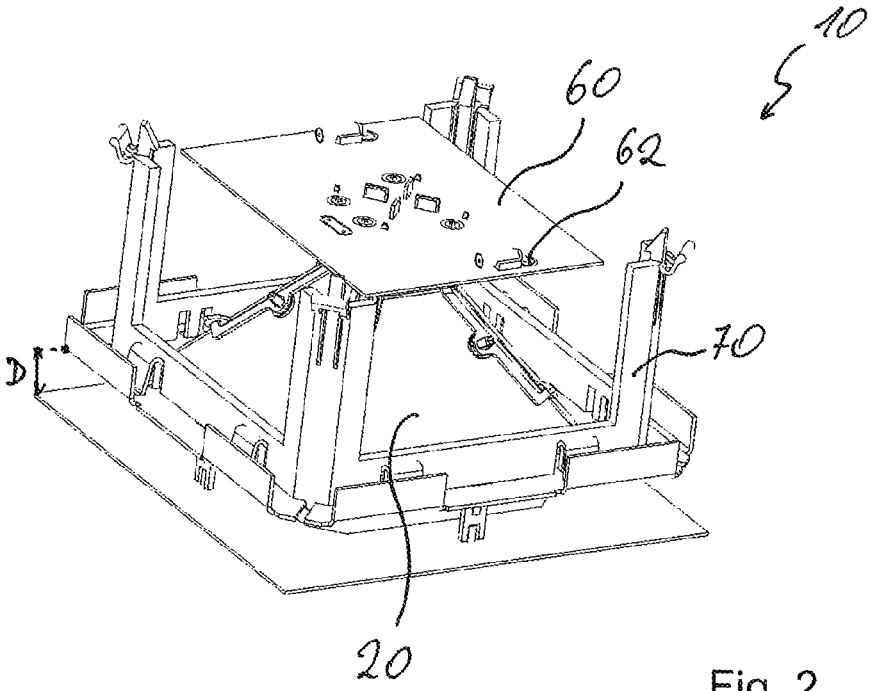
FIG. 2 shows a perspective view of the bottom of the dual band antenna element of FIG. 1.
Figure 3:
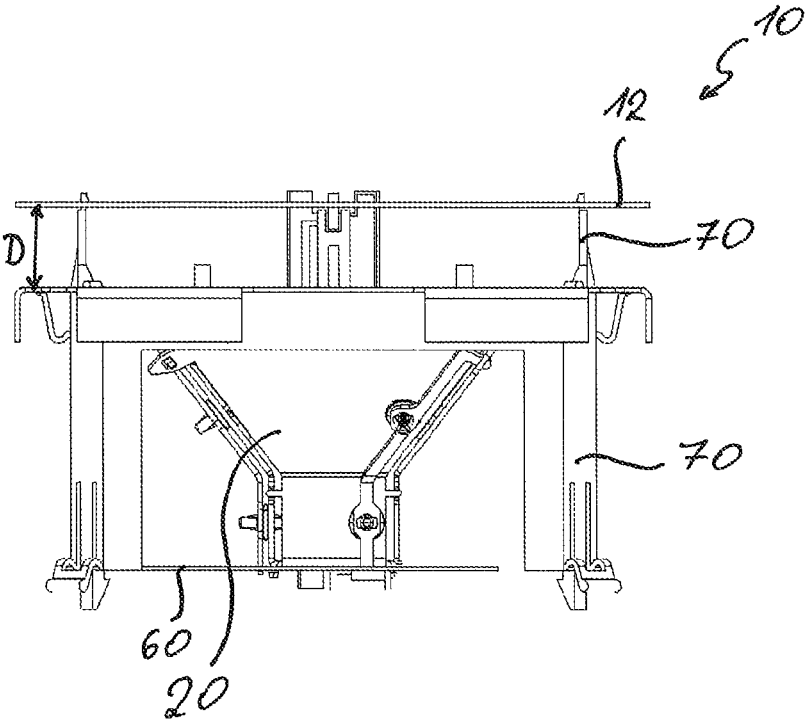
FIG. 3 shows a side view of the dual band antenna element of FIG. 1.

Aspects of a dual band antenna element 10 according to an embodiment of the invention are shown in FIG. 1 to FIG. 5.

The dual band antenna element 10 comprises a first radiating element 20 which is, in this particular embodiment, cup-shaped. An open side of the cup-shape may define a main radiating direction. In particular, the main radiating direction may be perpendicular to a plane defined by a rim of the cup-shape. The main radiation direction is the direction where the antenna element 10 has its maximum power of radiation. It should be understood that the main radiation direction is not necessarily the direction where an antenna array comprising such antenna elements 10 has its maximum power of radiation.

A first ring 30 is provided in the main radiation direction at a predetermined distance D from the first radiating element 20. The first ring 30 is arranged such that, when the dual band antenna element 10 is viewed in the main radiating direction, it overlaps the first radiating element 20 at least partially.

The first ring 30 is electrically closed and floating, which means that it is not fed itself. Thereby, it forms a parasitic ring. The first ring is electrically closed at least for signals at frequencies in a first frequency band covered by the first radiating element 20. This means that for such signals the first ring 30 is conductive. Hence, the first ring 30 can be continuous (as shown in the embodiment in FIG. 1). But the first ring 30 can also be discontinuous with gaps between conductive parts chosen so that the overall ring is still conductive for the signals at frequency in first frequency band. A corresponding definition also applies for the second ring 50 and a second frequency band described later on.

With the first ring 30 a size reduction (especially in width) of the first radiating element 20 can be achieved when compared to a solution without the first ring 30. This is achieved by choosing the first ring 30 and its location with respect to the first radiating element 20 so that a resonance frequency of the first radiating element 20 together with the first ring 30 is lower than a resonance frequency of the first radiating element 20 alone. Hence, the first ring 30 reduces the higher resonance frequency of the first radiating element 20 into the desired lower first frequency range. Thereby a smaller radiating element 20 can be used when compared to solutions without such a ring. A corresponding functionality also applies for the second ring 50 and the second radiating element 40 described later on.

The first ring 30 has substantially the same outer dimensions as the first radiating element 20 when viewed in the radiating direction. In the present embodiment, the first radiating element 20 has a substantially rectangular shape when viewed in the radiating direction. The first ring 30 similarly has a rectangular shape. In this embodiment both the radiating element 20 and the first ring 30 even have a square shape. The skilled person has knowledge of many such shapes that may be used both for the first radiating element 20 as well as the first ring 30. While in this embodiment, both the first radiating element 20 and the first ring 30 have a substantially rectangular shape, it is not required. In general, to keep good isolation, in general a shape with some degree of symmetry is preferred, e.g. circular, square, octagonal. It is also not required for both elements to have an identical shape. The first ring 30 also has substantially the same outer dimensions as the first radiating element 20. In particular, the first ring 30 may have outer dimensions, e.g. width or length, that differ from the outer dimensions of the first radiating element 20 by 0.1 of a wavelength lambda at the center frequency of the first frequency band.

The dual band antenna element 10 further comprises a second radiating element 40. The first radiating element 20 is usable in the first frequency band and the second radiating element 40 is usable in the second frequency band. Each of the frequency bands has a center frequency, wherein the center frequency of the second frequency band is higher than the center frequency of the first frequency band.

The second radiating element 40 is, when viewed in the main radiating direction, arranged within a circumference of the first radiating element 20. This means that, when projected onto a plane perpendicular to the main radiating direction, the projection of the second radiating element 40 is comprised within the projection of the first radiating element 20. It does not necessarily mean that the second radiating element 40 is surrounded by the cup-shaped walls of the first radiating element 20. Rather, in this embodiment, the second radiating element 40 is arranged at the predetermined distance D from the first radiating element 20 in the main radiation direction. It is thus arranged at about the same distance from the radiating element 20 as the first ring 30. By this both first ring 30 and the first radiating element can be arranged on the same carrier 12.

A second electrically closed ring 50 may be arranged around the second radiating element 40 to act as a parasitic ring. The second ring 50 may surround the second radiating element 40. The second ring 50 thus functions for the second radiating element 40 in the second frequency band in a similar manner as does the first ring 30 for the first radiating element 20 in the first frequency band.

The first ring 30, the second radiating element 40 and the second ring 50 may be arranged at the same height and may, for example, be arranged on a common carrier 12. The common carrier 12 may be a printed circuit board or any similar construction allowing for the formation of the first ring 30, the second radiating element 40 and the second ring 50 out of conductive material (e.g. wire traces) on the carrier 12. Although in the embodiment shown in FIG. 1 the first ring 30, the second radiating element 40 and the second ring 50 are all implemented on the same metallic layer of the carrier 12, in further embodiments these elements could also be implemented on different metallic layers of the carrier 12 (e.g. on opposite sides).

The first radiating element 20 may be connected to a bottom printed circuit board 60. The printed circuit board 60 may comprise interfaces 62 for connecting the first radiating element 20 to a distribution network (not shown). The printed circuit board 60 may further comprise transmission lines 61 which electrically connect the first radiating element 20 to the interface 62.

Furthermore, the dual band antenna element 10 comprises filtering structures, for example filtering lines 63 described later in conjunction with FIG. 8, which may be arranged at the same position as the feeding points of the first radiating element 20. Feeding points are positions at which the currents are excited into the first radiating element 20. They are the points where the feeding network ends and the radiating structure starts.

The distance (D) between the first radiating element 20 and the first ring 30 may be at most for example 0.15 of a wavelength (lambda) at the center frequency of the first frequency band.

The first radiating element 20 may comprise four slots which are arranged in a circular fashion every 90° and are arranged such that each slot can be excited. These excitations may be combined to obtain a certain polarization for a radio frequency (RF) signal radiated by the second radiating element 20. Such a polarization may, for example, be a dual linear polarization or a single or dual circular polarization. Each slot may be fed or excited with a bent metal sheet feeding line. These feeding lines may be combined in the bottom printed circuit board 60 such that the polarization is achieved. Such a structure forms a square dipole.

The dual band antenna elements 10 may comprise a dielectric support 70 on which the first radiating element 20, the second radiating element 40 and the first ring 30 may be mounted. The dielectric support 70 ensures mechanical stability and that the distance (D) from the first radiating element 20 to the first ring 30 and the second radiating element 40 is fixed. This simplifies assembly of the dual band antenna element 10 considerably.

Figure 4:
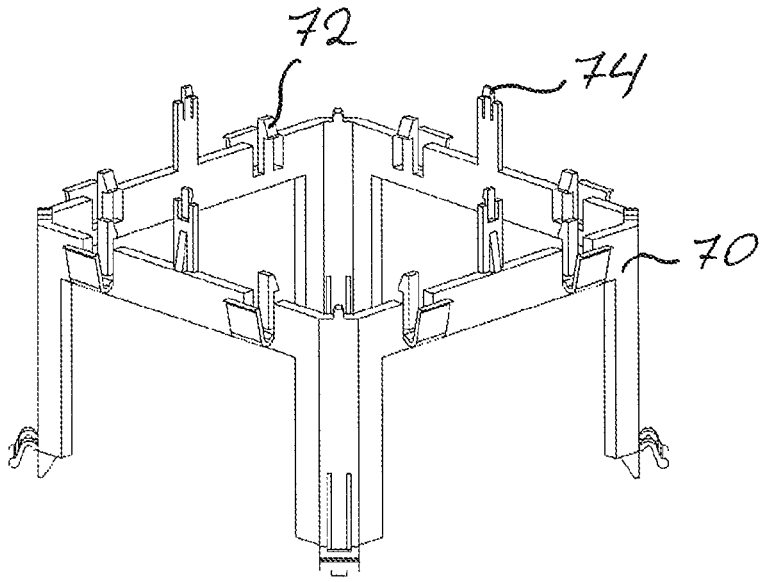
FIG. 4 shows a perspective view of a support structure of the dual band antenna element of FIG. 1.

As shown in FIG. 4, the dielectric support 70 may comprise clips 72, 74 to fixate the first radiating element 20 and/or the second radiating element 40.

Overall, the height of the dual band antenna element 10 from bottom printed circuit board 60 to the carrier 12 is in this embodiment less than 0.2 of the wavelength at the center frequency of the first frequency band. The width of the dual band antenna element 10 is, in this embodiment, less than 0.32 of the wavelength at the center frequency of the first frequency band. The width, in this case, designated the extent of the dual band antenna element 10 in a direction perpendicular to the main radiating direction.

The first ring 30 arranged on top of the first radiating element 20 allows to achieve a size reduction of about 30% compared to a similar radiating element without a first ring 30.

The second radiating element 40 is located above the first radiating element 20 and substantially at the same height as the first ring 30. The first ring 30 may thus also serve as an additional component to control the radiation of the second radiating element 40. Lifting the second radiating element 40 out of the cup-shaped first radiating element 20 to the height of the first ring 30 does not increase the height of the dual band antenna element 10 as the height of the first ring 30 still defines the outer size of the dual band antenna element 10.

The first ring 30 is electrically closed for the first frequency band but does not need to be continuous. The second ring 50 is electrically closed for the second frequency band but does not need to be continuous. Both rings 30, 50 may for example be floating.

The first frequency band and the second frequency band may be non-overlapping. In particular, the first frequency band may, for example, reach from 690 MHz to 960 MHz. The second frequency band may reach from, for example, 1.427 GHz to 2.69 GHz. This would lead to the first radiating element 20 to have a relative bandwidth of 32.7% and for the second radiating element 42 have a relative bandwidth of 61.3%.

When a printed circuit board is used to carry the first ring 30 and the second radiating element 40, the first ring 30 and the second radiating element 40 may also be located on opposing surfaces of the printed circuit board.

Figure 5:
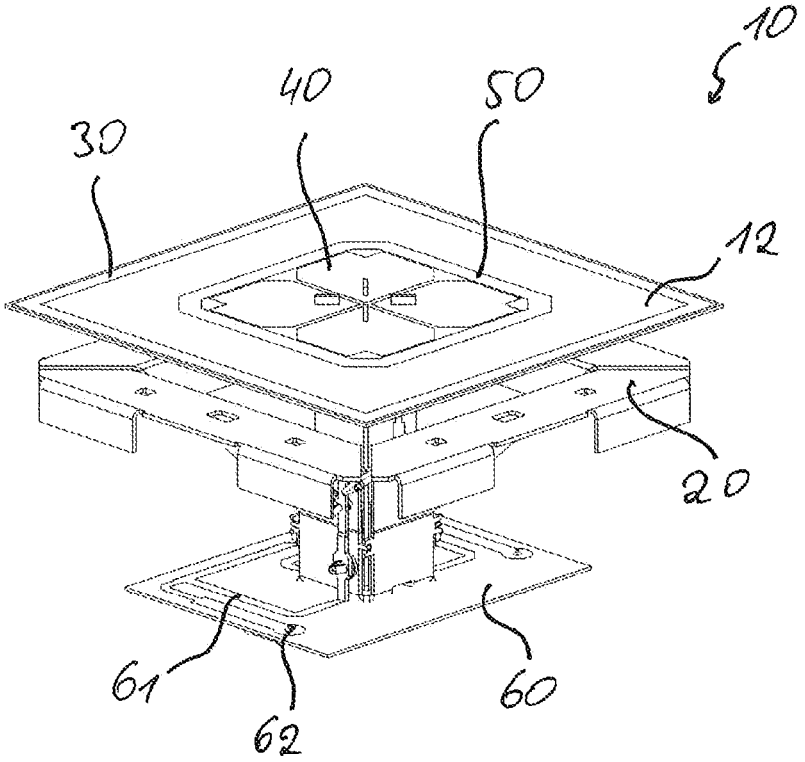
FIG. 5 shows a perspective view as in FIG. 1 without the support structure.
Figure 6:
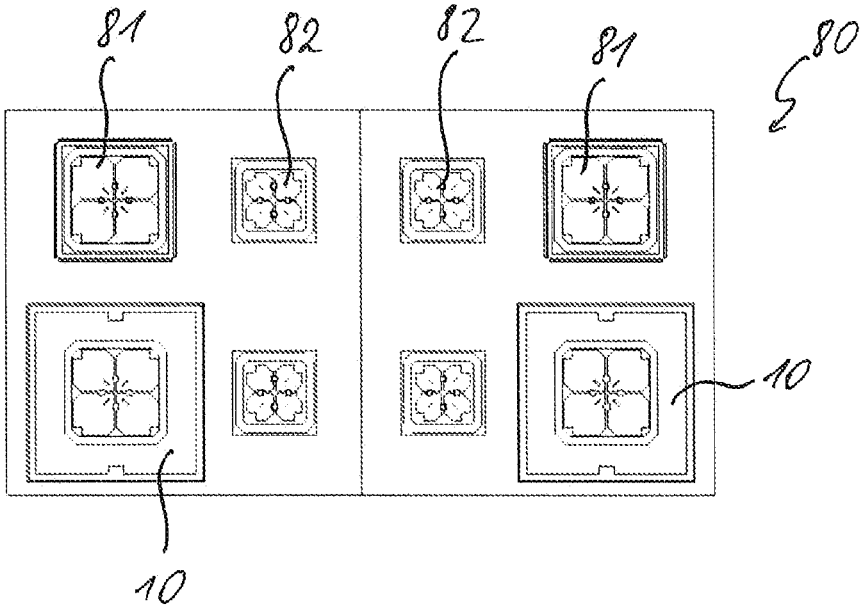
FIG. 6 shows a top view of an antenna architecture.
Figure 7:
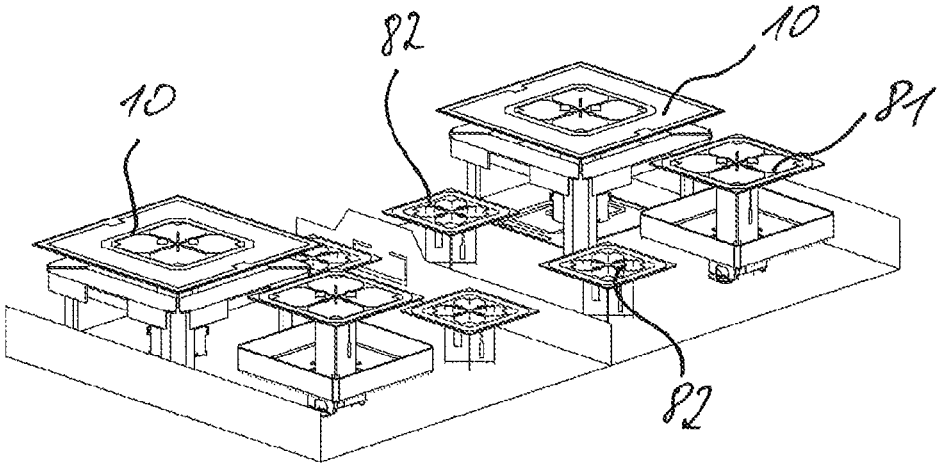
FIG. 7 shows a perspective view of the antenna architecture of FIG. 6.

The dual band antenna element 10 may be used in an antenna array 80 as shown in FIG. 5 and FIG. 6. The antenna array 80 comprises dual band antenna elements 10 as well as antenna elements 81 of a second type and antenna elements 82 of a third type. The dual band antenna elements 10 are suitable for use in both the first frequency band and the second frequency band. The antenna elements 82 are only suitable for use in the second frequency band. As the dual band antenna elements 10 thus include the functionality of the antenna elements 82, the antenna array 80 unites many more radiating elements for different frequency bands in a compact manner than would be possible if each of the antenna elements was only suitable for one frequency band. This makes it possible to include the further antenna elements 82 in the central section without increasing a width of the antenna array 80.

Thus, the invention allows construction of antenna arrays that are usable for MIMO operation in the second frequency band while minimizing the antenna array dimensions.

Figure 8:
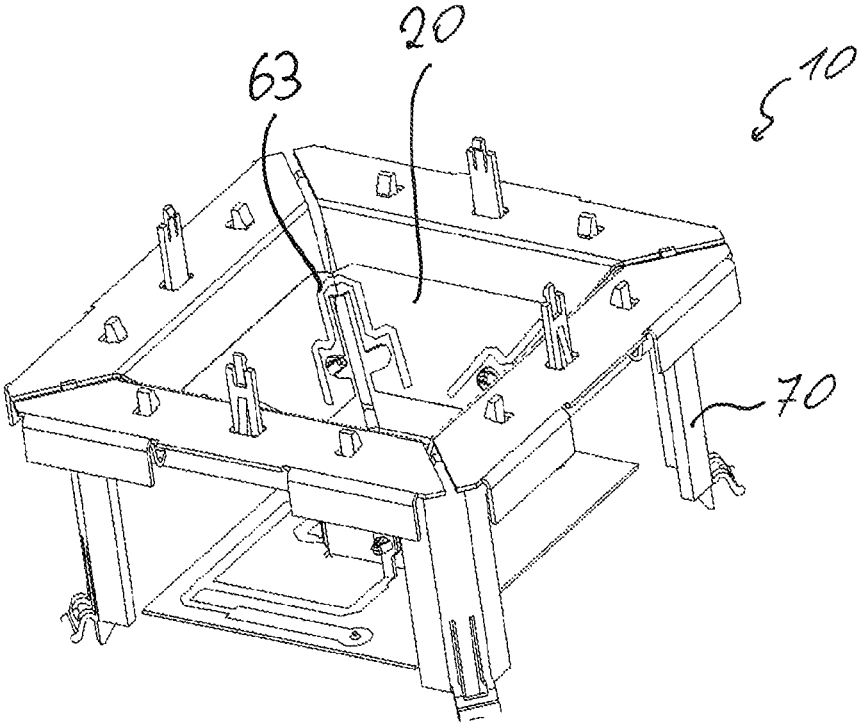
FIG. 8 shows a perspective view of a first radiating element of the dual band antenna element of FIG. 1

In a further embodiment as shown in FIG. 8, filtering lines 63 are provided. The filtering lines 63 may be placed close to slots of the first radiating element 20. To show a possible arrangement of the filtering lines 63, the carrier 12, which would otherwise obstruct the view on the filtering lines 63, is not shown in FIG. 8.

By using filtering lines 63, the inter-band isolation can be improved. This means that the coupling of the first frequency band and the second frequency band signals is reduced. By changing a length of the filtering lines 63 the frequency at which the coupling is reduced can be set. The filtering lines 63 also improve the radiation pattern and the directivity of the dual band antenna element 10.

Figure 9:
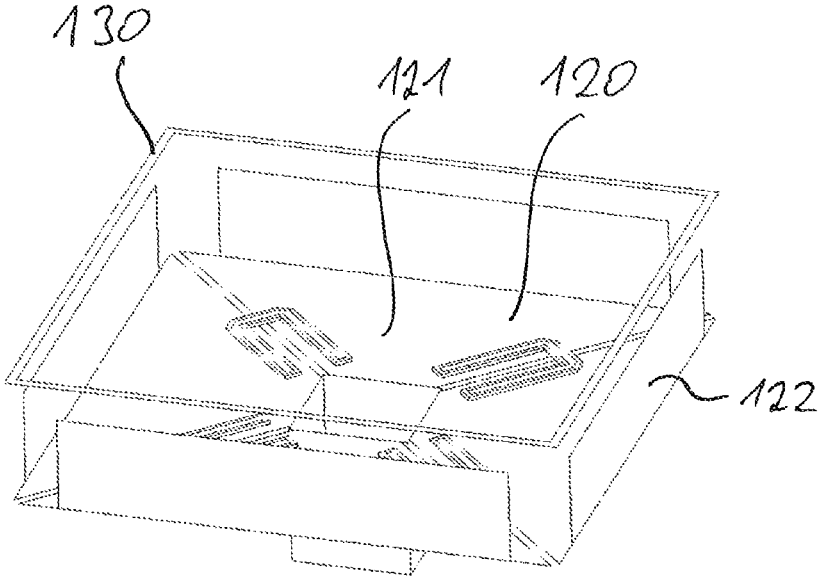
FIG. 9 shows a schematic perspective view of the top of a first radiating element of a further embodiment of the dual band antenna element.

FIG. 9 shows a further example of a first radiating element 120 and a first ring 130 which may be used instead of the previously described first radiating element 20 and first ring 30 in the dual band antenna element 10. In particular, instead of providing a cup-shape with tilted walls, the first radiating element 120 has a flat base 121 and surrounding edge walls 122 to provide the cup-shape.

The wording "substantially at the predetermined distance" may mean that the distance is within for example 0.1 of the wavelength at the center frequency of the second frequency band.

Embodiments of the invention as described herein allow the construction of compact antenna arrays 80 as they provide a way to embed a radiating element for a higher frequency in a radiating element for a lower frequency. The dual band antenna element has a minimized footprint and therefore reduces the shadowing of high frequency band antenna elements which might be arranged on its sides in multiband antenna arrays. Furthermore, the dual band antenna element is low profile and still broadband enough to cover the standard operating bands. The reduced size of the antenna arrays simplifies new site acquisition and site upgrades. Existing mechanical support structures may be reused as the wind load of the antenna system according to the invention may be equivalent to that of previously installed antenna systems.

The invention has been described in conjunction with various embodiments herein. However, other variations to the disclosed embodiments can be understood and affected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The number of certain elements used in the embodiments may be changed according to the needs as determined by the skilled person, e.g. the number of radiating elements, feeding lines, dipole devices and the numbers given herein shall not be understood to delimit the invention. The mere fact that certain measures are recited in mutually different dependent claims does not indicate that the combination of these measures cannot be used to advantage. Although the present invention and its advantages have been described in detail, it should be understood that various changes, substitutions, alterations, modifications and combinations can be made herein without departing from the spirit and scope of the invention as defined by the appended claims.

The invention claimed is:

1. A dual band antenna element having a main radiating direction, comprising:

a first radiating element for use in a first frequency band;

a first electrically closed ring for use in the first frequency band galvanically isolated from and arranged at a predetermined distance (D) from the first radiating element in the main radiating direction, wherein the first electrically closed ring at least partially overlaps the first radiating element in the main radiating direction; and a second radiating element for use in a second frequency band, wherein a center frequency of the second frequency band is higher than a center frequency of the first frequency band, wherein the second radiating element is arranged within a circumference of the first radiating element, wherein the second radiating element is arranged substantially at the predetermined distance (D) from the first radiating element in the radiation direction, and a second electrically closed ring for use in the second frequency band, the second electrically closed ring surrounding the second radiating element.

2. The dual band antenna element according to claim 1, wherein the first electrically closed ring has substantially the same outer dimensions as the first radiating element when viewed in the radiating direction.

3. The dual band antenna element according claim 1, wherein the predetermined distance between the first electrically closed ring and the first radiating element is at most 0.15 of a wavelength (lambda) at the center frequency of the first frequency band.

4. The dual band antenna element according to claim 1, wherein the first electrically closed ring is floating.

5. The dual band antenna element according to claim 1, wherein the first electrically closed ring is arranged at the same height as the second radiating element.

6. The dual band antenna element according to claim 1 wherein the first electrically closed ring and the second radiating element are arranged on the same carrier.

7. The dual band antenna element according to claim 1, wherein the dual band antenna element comprises filtering structures at feeding points of the first radiating element.

8. A dual band antenna element having a main radiating direction, comprising:

a first radiating element for use in a first frequency band;

a first electrically closed ring for use in the first frequency band galvanically isolated from and arranged at a predetermined distance (D) from the first radiating element in the main radiating direction, wherein the first electrically closed ring at least partially overlaps the first radiating element in the main radiating direction; and a second radiating element for use in a second frequency band, wherein a center frequency of the second frequency band is higher than a center frequency of the first frequency band, wherein the second radiating element is arranged within a circumference of the first radiating element, wherein the second radiating element is arranged substantially at the predetermined distance (D) from the first radiating element in the radiation direction, wherein the first radiating element comprises four slots regularly arranged in a circular fashion every 90°, wherein each slot can be excited so that excitations are combined to obtain a certain polarization for a radio frequency (RF) signal radiated by the first radiating element.

9. The dual band antenna element according to claim 1, wherein the first radiating element has a cup shape form for embedding the second radiating element.

10. The dual band antenna element according to claim 1, wherein a height of the dual band antenna element is less than 0.2 of a wavelength at the center frequency of the first frequency band.

11. The dual band antenna element according to claim 1, wherein a width of the dual band antenna element is less than 0.32 of a wavelength at the center frequency of the first frequency band.

12. The dual band antenna element according to claim 1, wherein a relative bandwidth of the dual band antenna element is more than 30% in the first frequency band.

13. The dual band antenna element according to claim 1, wherein a relative bandwidth of the dual band antenna element is more than 60% in the second frequency band.

14. The dual band antenna element according to claim 1, further comprising:

a bottom printed circuit board, wherein the first radiating element is connected to the bottom printed circuit board, wherein the bottom printed circuit board comprises transmission lines and an interface for connecting the first radiating element to a distribution network.

* * * * *